US011345567B2

(12) United States Patent
Ginsberg et al.

(10) Patent No.: US 11,345,567 B2
(45) Date of Patent: May 31, 2022

(54) ELEVATOR SHORT-RANGE COMMUNICATION SYSTEM

(71) Applicant: OTIS ELEVATOR COMPANY, Farmington, CT (US)

(72) Inventors: David Ginsberg, Granby, CT (US); Suman Dwari, Vernon, CT (US); Xin Wu, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 940 days.

(21) Appl. No.: 16/082,127

(22) PCT Filed: Mar. 3, 2017

(86) PCT No.: PCT/US2017/020667
§ 371 (c)(1),
(2) Date: Sep. 4, 2018

(87) PCT Pub. No.: WO2017/152055
PCT Pub. Date: Sep. 8, 2017

(65) Prior Publication Data

US 2019/0100406 A1 Apr. 4, 2019

Related U.S. Application Data

(60) Provisional application No. 62/303,717, filed on Mar. 4, 2016.

(51) Int. Cl.
*B66B 1/34* (2006.01)

(52) U.S. Cl.
CPC ..... *B66B 1/3461* (2013.01); *B66B 1/3423* (2013.01); *B66B 1/3453* (2013.01)

(58) Field of Classification Search
CPC .... B66B 1/3461; B66B 1/3423; B66B 1/3453
See application file for complete search history.

(56) References Cited

U.S. PATENT DOCUMENTS 6,598,710 B2 7/2003 Motoyama et al.
6,601,679 B2 8/2003 Crenella et al.
7,664,464 B2 2/2010 Gerstenkorn
(Continued)

FOREIGN PATENT DOCUMENTS

CA 2917279 A1 2/2015
CN 1509252 A 6/2004
(Continued)

OTHER PUBLICATIONS

ISR/WO, Issued Jul. 21, 2017, 23 pages.

*Primary Examiner* — Jeffrey Donels
(74) *Attorney, Agent, or Firm* — Cantor Colburn LLP

(57) ABSTRACT

An elevator system includes an elevator car (28) disposed in and constructed and arranged to move along a hoistway (26) generally defined by a stationary structure. A short-range communication system of the elevator system is configured to provide communication between the elevator car and the stationary structure, and may include a transceiver (62, 64) carried by the elevator car and a plurality of transceivers (66) spaced along the hoistway. A network coordinator (68) of the communication system is operatively coupled to the plurality of hoistway transceivers to provide uninterrupted communication.

13 Claims, 4 Drawing Sheets

(56) References Cited

U.S. PATENT DOCUMENTS

| | | | | |
|---|---|---|---|---|
| 8,047,333 | B2 | 11/2011 | Finschi | |
| 10,703,606 | B2 * | 7/2020 | Salmikuukka | B66B 11/0226 |
| 2002/0189907 | A1 | 12/2002 | Motoyama et al. | |
| 2010/0257239 | A1 | 10/2010 | Roberts | |
| 2012/0108169 | A1 | 5/2012 | Degauque et al. | |
| 2012/0129458 | A1 * | 5/2012 | Yim | B66B 1/34 455/66.1 |
| 2014/0067682 | A1 | 3/2014 | Song | |
| 2014/0231185 | A1 | 8/2014 | Salmikuukka et al. | |
| 2015/0133047 | A1 | 5/2015 | Smith et al. | |
| 2015/0158694 | A1 | 6/2015 | Finschi et al. | |
| 2015/0187151 | A1 | 7/2015 | Lagerstedt et al. | |
| 2015/0314984 | A1 | 11/2015 | McCarthy et al. | |
| 2015/0368067 | A1 | 12/2015 | Tang et al. | |
| 2016/0185568 | A1 * | 6/2016 | Kusserow | H04W 52/0203 340/3.31 |
| 2016/0311656 | A1 * | 10/2016 | Rodriguez | B66B 11/0407 |

FOREIGN PATENT DOCUMENTS

| | | | |
|---|---|---|---|
| EP | 0757011 | A2 | 2/1997 |
| JP | H07170558 | A | 7/1995 |
| WO | 2014113006 | A1 | 7/2014 |
| WO | 2014186946 | A1 | 11/2014 |
| WO | 2015018697 | A1 | 2/2015 |
| WO | 2016126686 | A1 | 8/2016 |

* cited by examiner

ELEVATOR SHORT-RANGE COMMUNICATION SYSTEM

CROSS-REFERENCE TO RELATED APPLICATIONS

This application claims the benefit of PCT/US2017/020667 filed Mar. 3, 2017, which claims priority to U.S. Provisional Application No. 62/303,717 filed Mar. 4, 2016, which is incorporated herein by reference in its entirety.

BACKGROUND

The present disclosure relates to elevator systems, and more particularly to a short-range communication system of the elevator system.

Traveling electrical cables are traditionally used to power and to communicate with moving elevator cars of an elevator system. The moving cable based solution is disadvantageous for long and fast motions, due to its mechanical and electrical limitations. Moreover, more current, rope-less, elevator system often with multiple cars traveling in a single hoistway lane do not utilize cables and thus depend on wireless communication between the hoistway and elevator car(s). Improvements in conventional wireless communication systems for the application of elevator systems is desirable.

SUMMARY

An elevator system according to one, non-limiting, embodiment of the present disclosure includes an elevator car disposed in and constructed and arranged to move along a hoistway generally defined by a stationary structure; and a short-range communication system configured to provide communication between the elevator car and the stationary structure, the short-range communication system including a first car transceiver carried by the elevator car, a plurality of hoistway transceivers spaced along the hoistway, and a first network coordinator operatively coupled to the plurality of hoistway transceivers to provide un-interrupted communication.

Additionally to the foregoing embodiment, the short-range communication system includes a second car transceiver carried by the elevator car and spaced vertically from the first car transceiver.

In the alternative or additionally thereto, in the foregoing embodiment, the short-range communication system includes a second network coordinator operatively coupled to the first and second car transceivers to facilitate un-interrupted communication.

In the alternative or additionally thereto, in the foregoing embodiment, the short-range communication system is a near field communication system.

In the alternative or additionally thereto, in the foregoing embodiment, the elevator system includes a linear propulsion system constructed and arranged to propel the elevator car, the linear propulsion system including a plurality of primary coils engaged to and distributed along the hoistway.

In the alternative or additionally thereto, in the foregoing embodiment, the elevator system includes a linear propulsion system constructed and arranged to propel the elevator car, the linear propulsion system including a plurality of primary coils engaged to and distributed along the hoistway.

In the alternative or additionally thereto, in the foregoing embodiment, the plurality of primary coils and the plurality of hoistway transceivers are commonly modularized in a stacked orientation.

In the alternative or additionally thereto, in the foregoing embodiment, a spacing between centerpoints of the first and second car transceivers is greater than a spacing between centerpoints of adjacent hoistway transceivers of the plurality of hoistway transceivers.

In the alternative or additionally thereto, in the foregoing embodiment, a vertical distance measured between the first and second car transceivers is less than a height of the elevator car.

In the alternative or additionally thereto, in the foregoing embodiment, the elevator system includes at least one sensor carried by the elevator car and configured to output a signal to the second network coordinator.

In the alternative or additionally thereto, in the foregoing embodiment, the at least one sensor is configured to monitor at least one of a speed of the elevator car, an acceleration of the elevator car, a load in the elevator car, a position of one or more doors of the elevator car, and a position of one or more brakes of the elevator car.

In the alternative or additionally thereto, in the foregoing embodiment, the second network coordinator includes a microprocessor.

In the alternative or additionally thereto, in the foregoing embodiment, the elevator system includes a linear propulsion system constructed and arranged to propel the elevator car, the linear propulsion system including a plurality of primary coils engaged to and distributed along the hoistway.

In the alternative or additionally thereto, in the foregoing embodiment, the linear propulsion system includes a control system configured to select and energize the plurality of primary coils, the control system including a plurality of switches with each one of the plurality of switches being associated with a respective one of the plurality of primary coils, and wherein the plurality of switches selectively close to energize a selected one of the plurality of primary coils associated with a location of the elevator car.

In the alternative or additionally thereto, in the foregoing embodiment, the first network coordinator is operatively associated with the control system.

A rope-less elevator system according to another, non-limiting, embodiment includes an elevator car disposed in and constructed and arranged to move along a hoistway generally defined by a stationary structure; and a short-range communication system configured to provide communication between the elevator car and the stationary structure, the short-range communication system including a first car transceiver and a second car transceiver spaced below the first car transceiver and carried by the elevator car, a plurality of hoistway transceivers spaced along the hoistway, a first network coordinator operatively coupled to the plurality of hoistway transceivers and carried by the stationary structure to facilitate un-interrupted communication, and a second network coordinator operatively coupled to the first and second car transceivers and carried by the elevator car to facilitate uninterrupted communication.

Additionally to the foregoing embodiment, the short-range communication system is a near field communication system.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
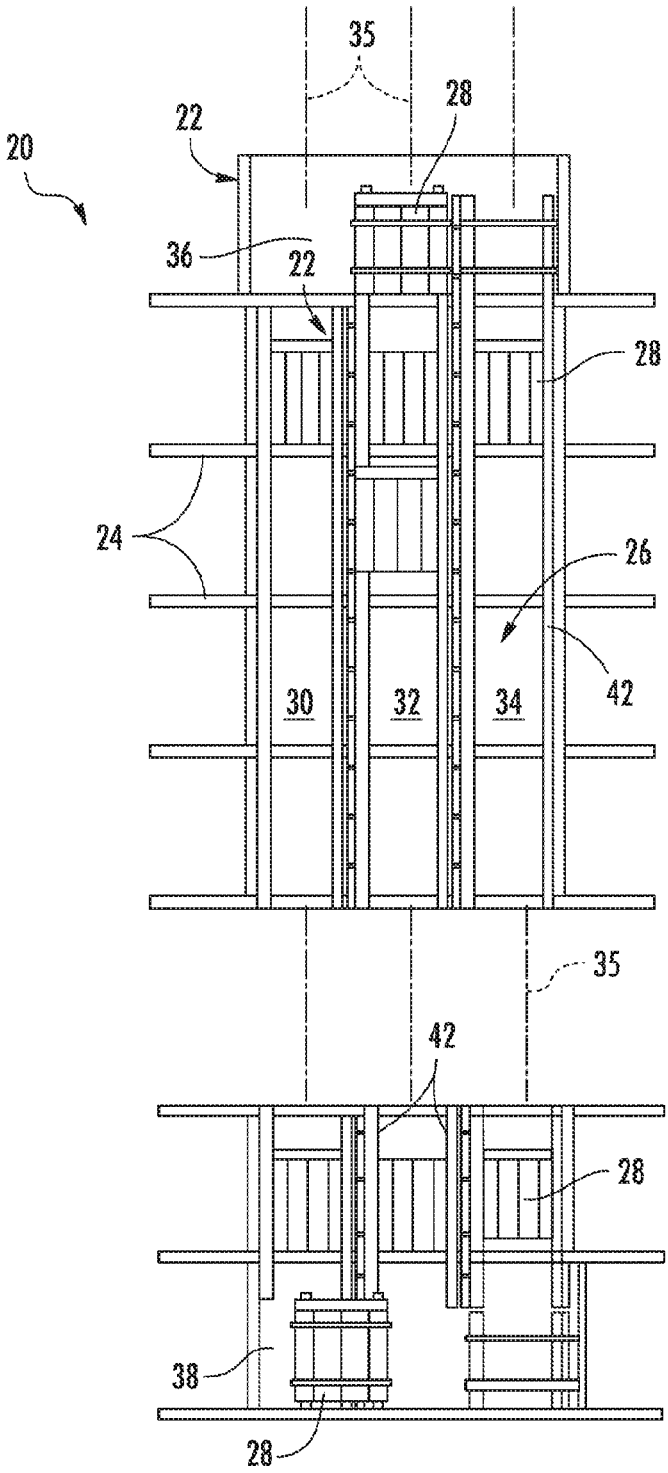
FIG. 1 depicts a multicar elevator system in accordance with the present disclosure.

FIG. 1 depicts an elevator system 20 in an exemplary embodiment that may be self-propelled or rope-less, and used in a structure or building 22 having multiple levels or floors 24. Elevator system 20 includes a hoistway 26 having boundaries defined by the structure 22 and at least one car 28 adapted to travel in the hoistway 26. The hoistway 26 may include, for example, three lanes 30, 32, 34 each extending along a respective centerline 35 with any number of cars 28 traveling in any one lane and in any number of travel directions. For example and as illustrated, the cars 28 in lanes 30, 34, may travel in an up direction and the cars 28 in lane 32 may travel in a down direction along the centerline 35. Moreover, the cars 28 may travel horizontally along a centerline 35 within upper and lower transfer stations 36, 38.

Above the top floor 24 may be the upper transfer station 36 that facilitates horizontal motion to elevator cars 28 for moving the cars between lanes 30, 32, 34. Below the first floor 24 may be the lower transfer station 38 that facilitates horizontal motion to elevator cars 28 for moving the cars between lanes 30, 32, 34. It is understood that the upper and lower transfer stations 36, 38 may be respectively located at the top and first floors 24 rather than above and below the top and first floors, or may be located at any intermediate floor. Yet further, the elevator system 20 may include one or more intermediate transfer stations (not illustrated) located vertically between and similar to the upper and lower transfer stations 36, 38.

Figure 2:
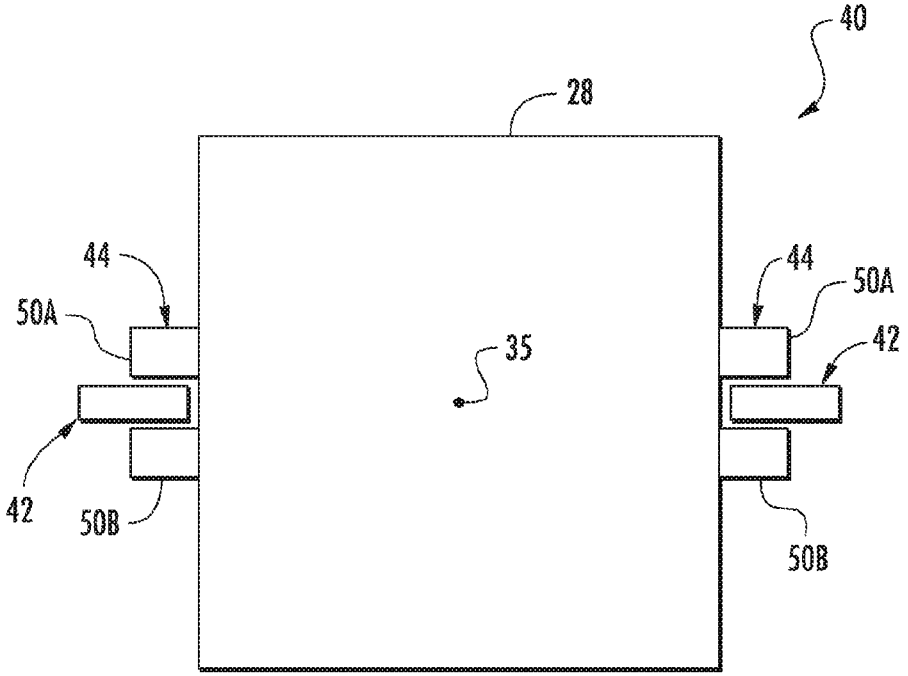
FIG. 2 is a top down view of an elevator car and portions of a linear propulsion system of the elevator system.
Figure 3:
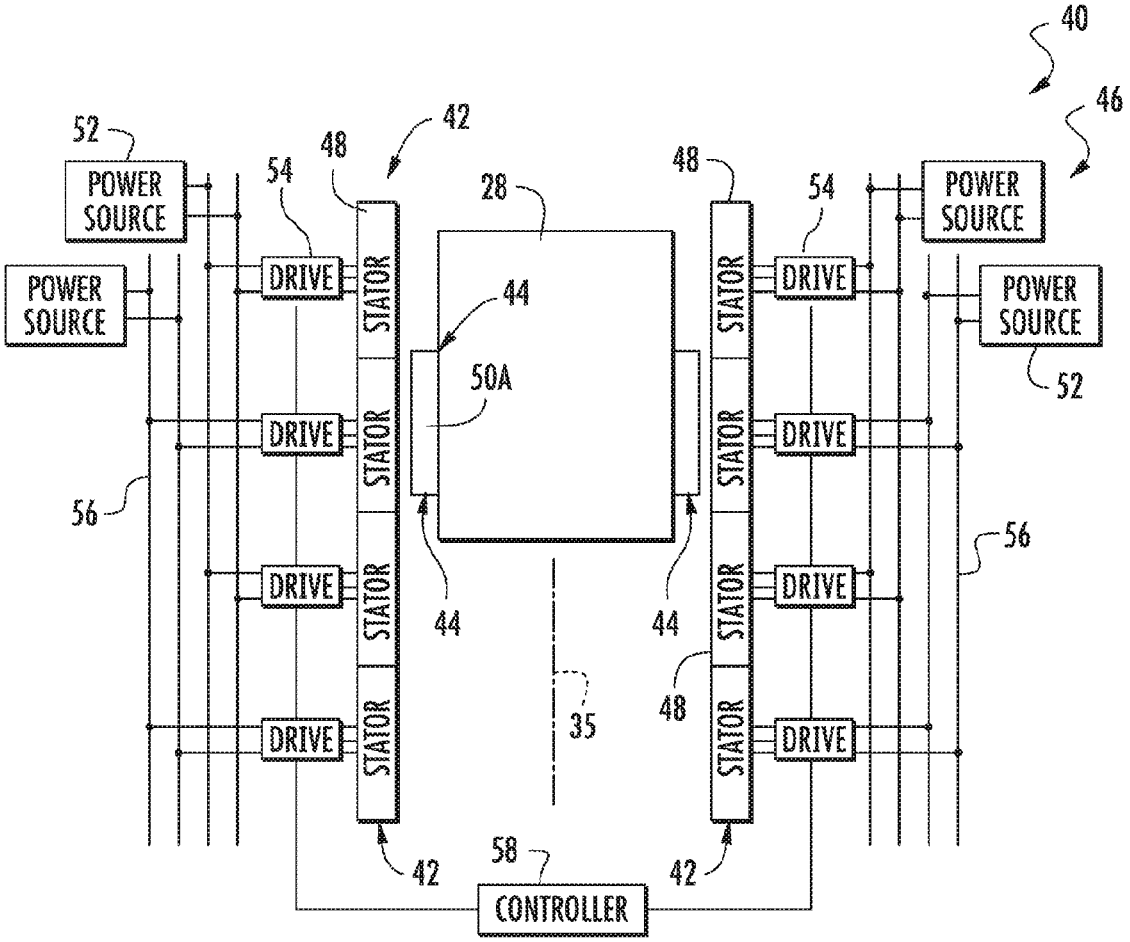
FIG. 3 is a schematic of the linear propulsion system.
Figure 4:
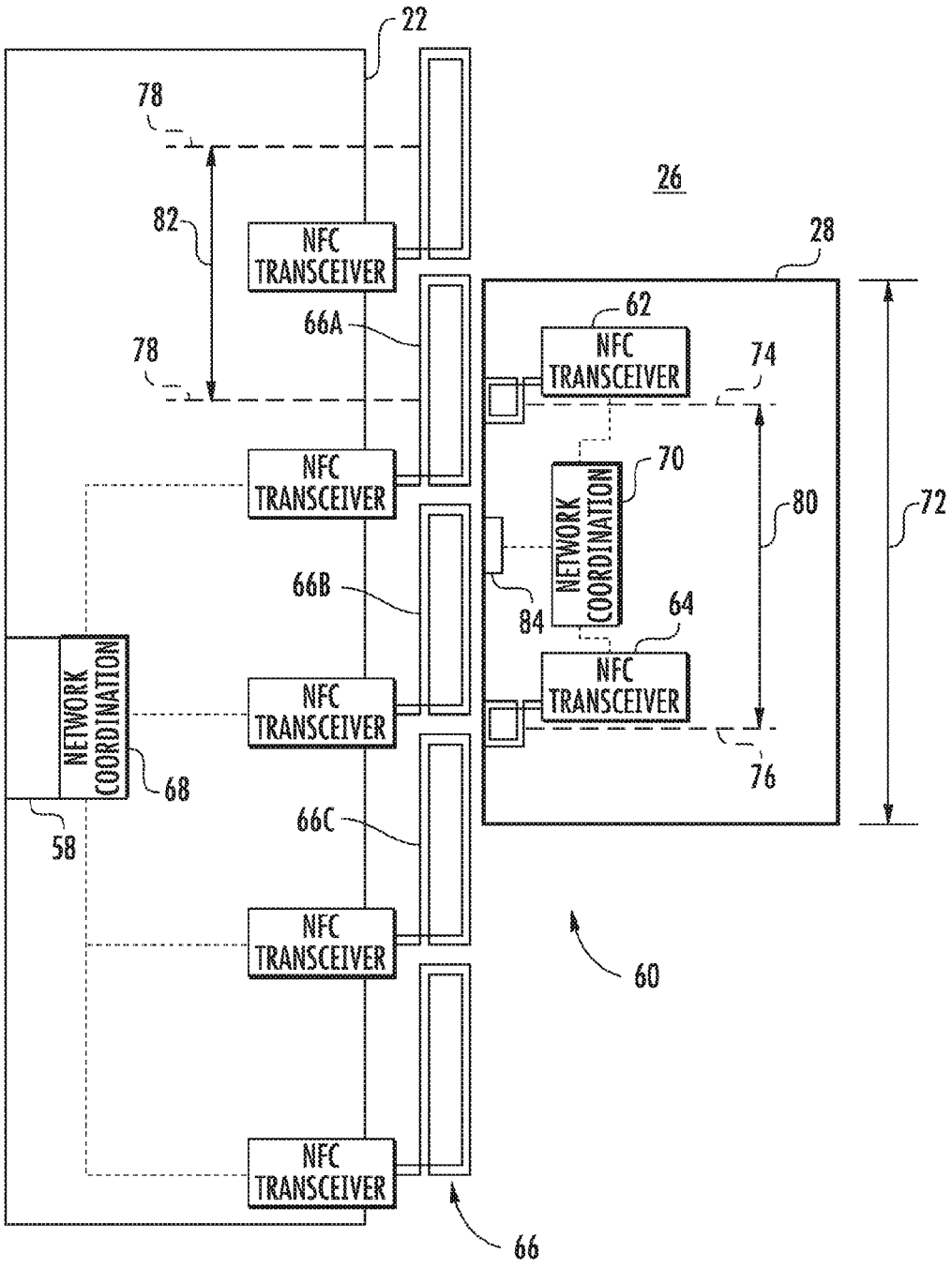
FIG. 4 is a schematic of a short-range communication system of the elevator system.

Referring to FIGS. 1 through 3, cars 28 are propelled using a linear propulsion system 40 having at least one, fixed, primary portion 42 (e.g., two illustrated in FIG. 2 mounted on opposite sides of the car 28), moving secondary portions 44 (e.g., two illustrated in FIG. 2 mounted on opposite sides of the car 28), and a control system 46 (see FIG. 4). The primary portion 42 includes a plurality of windings or coils 48 (i.e., primary coils) mounted at one or both sides of the lanes 30, 32, 34 in the hoistway 26. Each secondary portion 44 may include two rows of opposing permanent magnets 50A, 50B mounted to the car 28. Primary portion 42 is supplied with drive signals from the control system 46 to generate a magnetic flux that imparts a force on the secondary portions 44 to control movement of the cars 28 in their respective lanes 30, 32, 34 (e.g., moving up, down, or holding still). The plurality of coils 48 of the primary portion 42 may generally be located between and spaced from the opposing rows of permanent magnets 50A, 50B. It is contemplated and understood that any number of secondary portions 44 may be mounted to the car 28, and any number of primary portions 42 may be associated with the secondary portions 44 in any number of configurations.

Referring to FIG. 3, the control system 46 may include power sources 52, drives 54, buses 56 and a controller 58. The power sources 52 are electrically coupled to the drives 54 via the buses 56. In one non-limiting example, the power sources 52 may be direct current (DC) or alternating current (AC) power sources. DC power sources 52 may be implemented using storage devices (e.g., batteries, capacitors), and may be active devices that condition power from another source (e.g., rectifiers). AC power sources may be implemented using a power grid or an alternator. The drives 54 may receive DC power from the buses 56 and may provide drive excitation to the primary portions 42 of the linear propulsion system 40. Each drive 54 may be a converter that converts DC power from bus 56 to a multiphase (e.g., three phase) drive excitation provided to a respective section of the primary portions 42. The primary portion 42 is divided into a plurality of modules or sections, with each section associated with a respective drive 54.

The controller 58 provides control signals to each of the drives 54 to control generation of the drive signals. Controller 58 may output such commands as thrust and velocity to the drives 54. Each drive 54 may include a controller (not shown) that generates a pulse width modulation (PWM) to control the excitation of the stator coils as dictated by the command signals received from the controller 58. The controller 58 may be implemented using a digital signal processor-based device (e.g., microprocessor) programmed to generate the control signals. The controller 58 may also be part of an elevator control system or elevator management system. Elements of the control system 46 may be implemented in a single, integrated module, and/or be distributed along the hoistway 26.

Referring to FIG. 4, a short-range communication system 60 of the elevator system 20 provides wireless communication between the moving elevator car 28 and the stationary structure or building 22 that generally defines the hoistway 26. The short-range communication system 60 may be a near field communication system, and may include first and second car transceivers 62, 64, a plurality of hoistway transceivers 66, a network coordinator 68 associated with the hoistway 26, and a network coordinator 70 associated with the elevator car 28. The first and second car transceivers 62, 64 and the car network coordinator 68 are carried by the elevator car 28. For an elevator system 20 that moves in a vertical direction, the first car transceiver 62 may be spaced above the second transceiver 64. The plurality of hoistway transceivers 66 are stationary, generally engaged to the stationary structure 22, and are distributed and spaced along the hoistway 26. The transceivers 62, 64, 66 may generally be coils. It is further contemplated and understood that the short-range communication system 60 may be applied to any type of elevator system (i.e., rope-less or otherwise). It is further contemplated that more than 2 transceivers may be carried by the elevator car 28 and depends upon data fidelity requirements, hoistway coil size laminations, car length and/or cost.

The first and second transceivers 62, 64 are configured to receive and transmit communication signals, one at a time, to selected hoistway transceivers of the plurality of hoistway transceivers 66 in any given moment and dependent upon the motion of the elevator car 28. The first and second transceivers 62, 64 may be hardwired to the car network coordinator 70 that may generally select which car transceiver 62, 64 interacts with the plurality of hoistway transceivers 66 in any given moment in time and dependent upon a position of the elevator car 28. The selection between transceivers 62, 64 may be an active control and/or may be, at least in-part, passive. This interaction between transceivers 62, 64, 66 facilitates a continuous line of communication while the elevator car 28 is moving and wherever the elevator car may stop (i.e., becomes stationary). For example, if the upper car transceiver 62 is positioned directly across from a hoistway transceiver 66A and the lower car transceiver 64 is located generally between two adjacent hoistway transceivers 66B, 66C, then the car network coordinator 70 interacts with the upper car transceiver 62 and not the lower car transceiver 64 in that given moment in time.

The plurality of hoistway transceivers 66 are configured to receive and transmit communication signals, one at a time, to one of the selected car transceivers 62, 64 in any given moment in time. The plurality of transceivers 66 may be hardwired to the hoistway network coordinator 68 that may generally select which hoistway transceiver 66 interacts with the car transceivers 62, 66 in any given moment in time and dependent upon a position of the elevator car 28. This coordination of transceiver interaction assures a continuous line of communication with the elevator car 28 regardless of car position and motion. It is further contemplated and understood that multiple transceivers 66 may be active in any given moment in time provided they do not interfere with one-another.

The spacing between the car transceivers 62, 64 may be less than a height (see arrow 72) of the elevator car 28. The transceivers 62, 64, 66 may each have respective centerpoints or horizontal centerlines 74, 76, 78 such that the a distance (see arrow 80) measured between centerpoints 74, 76 may be greater than a distance (see arrow 82) measured between adjacent centerpoints 78 of adjacent hoistway transceivers 66, and may be about one and a half times greater than the distance 82. This orientation assures that one of the car transceivers is directly adjacent to a hoistway transceiver for optimized communication while the other car transceiver is between hoistway transceivers producing a degraded or no communication for that particular car transceiver utilized in the short-range communication system 20. One example of a distance 82 between adjacent centerpoints 78 of adjacent hoistway transceivers 66 may correspond directly to a length of the motor segments or multiples of it, and may be within a range of about 1 to 1.2 meters. Alternatively, the elevator car 28 may carry more than two transceivers depending upon the orientation of the hoistway transceivers and other characteristics of the short-range communication system.

The plurality of primary coils 48 and the plurality of hoistway transceivers 66 may be commonly modularized in a stacked orientation along the hoistway. That is, the primary side of the rope-less elevator system 20 may include a plurality of modular units generally stacked vertically along the hoistway 26 such that each modular unit is substantially identical and scalable, for example, with a high-rise building 22. More specifically, each modular unit may include at least one hoistway transceiver 66, at least one drive 54 and at least one primary coil 48.

The hoistway and/or car network coordinators 68, 70 may be a computer-based processor (e.g., microprocessor) configured to execute a computer program or software stored on a storage medium (not shown) to perform the operations described herein. Moreover, the hoistway network coordinator 68 may generally be a part of the controller 58 or may be a separate microprocessor. Alternatively, or in addition thereto, one or both circuits 68, 70 may be implemented via hardware (e.g., ASIC, FPGA) or in a combination of hardware (e.g., switches) and software.

The elevator system 20 may further include any variety of sensors 84 carried by the elevator car 28 and configured to output a data signal to the car network coordinator or microprocessor 70. The sensor(s) 84 may be configured to monitor at least one of a speed of the elevator car, an acceleration of the elevator car, a load in the elevator car, a position of one or more doors (not shown) of the elevator car, and a position of one or more brakes (not shown) of the elevator car. In one example, the short-range communication system 60 may be configured to receive data input from a position sensor 84 (e.g., accelerometer) for sending elevator car position data to the controller 58. Further, the communication system 60 may receive any other type of data from any variety of other sensors. Such data may include or is otherwise associated with fault detection, safety-related information, health monitoring, ride comfort, pressure, temperature, moisture, occupancy, and other data. It is further understood that data or instructions from the controller 58 may be transferred to the elevator car 28 by using the proposed communication channel.

Benefits of the present disclosure include an inexpensive and robust, wireless, communication to the elevator car 28, wherein communication may be established between car(s) and the hoistway 26 via near field coupling with a reduced likelihood of a wireless link failure due to interference. Moreover, the present disclosure may reduce any likelihood that any unwanted device may gain access to the information in the elevator system 20 because of the rapid attenuation of near-field signals.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. An elevator system, comprising:

an elevator car disposed in and constructed and arranged to move along a hoistway generally defined by a stationary structure; and a short-range communication system configured to provide communication between the elevator car and the stationary structure, the short-range communication system including a first car transceiver carried by the elevator car, a plurality of hoistway transceivers spaced along the hoistway, and a first network coordinator operatively coupled to the plurality of hoistway transceivers to provide un-interrupted communication, wherein the short-range communication system includes a second car transceiver carried by the elevator car and spaced vertically from the first car transceiver, wherein the short-range communication system includes a second network coordinator operatively coupled to the first and second car transceivers to facilitate un-interrupted communication, and wherein a vertical distance measured between the first and second car transceivers is less than a height of the elevator car.

2. The elevator system set forth in claim 1, wherein the short-range communication system is a near field communication system.

3. The elevator system set forth in claim 2 further comprising:

a linear propulsion system constructed and arranged to propel the elevator car, the linear propulsion system including a plurality of primary coils engaged to and distributed along the hoistway.

4. The elevator system set forth in claim 1 further comprising:

a linear propulsion system constructed and arranged to propel the elevator car, the linear propulsion system including a plurality of primary coils engaged to and distributed along the hoistway.

5. An elevator system comprising:

an elevator car disposed in and constructed and arranged to move along a hoistway generally defined by a stationary structure;

a short-range communication system configured to provide communication between the elevator car and the stationary structure, the short-range communication system including a first car transceiver carried by the elevator car, a plurality of hoistway transceivers spaced along the hoistway, and a first network coordinator operatively coupled to the plurality of hoistway transceivers to provide un-interrupted communication; and a linear propulsion system constructed and arranged to propel the elevator car, the linear propulsion system including a plurality of primary coils engaged to and distributed along the hoistway, wherein the plurality of primary coils and the plurality of hoistway transceivers are commonly modularized in a stacked orientation.

6. An elevator system comprising:

an elevator car disposed in and constructed and arranged to move along a hoistway generally defined by a stationary structure;

a short-range communication system configured to provide communication between the elevator car and the stationary structure, the short-range communication system including a first car transceiver carried by the elevator car, a plurality of hoistway transceivers spaced along the hoistway, and a first network coordinator operatively coupled to the plurality of hoistway transceivers to provide un-interrupted communication, wherein the short-range communication system includes a second car transceiver carried by the elevator car and spaced vertically from the first car transceiver, wherein the short-range communication system includes a second network coordinator operatively coupled to the first and second car transceivers to facilitate un-interrupted communication, and wherein a spacing between centerpoints of the first and second car transceivers is greater than a spacing between centerpoints of adjacent hoistway transceivers of the plurality of hoistway transceivers.

7. The elevator system set forth in claim 1 further comprising:

at least one sensor carried by the elevator car and configured to output a signal to the second network coordinator.

8. The elevator system set forth in claim 7, wherein the at least one sensor is configured to monitor at least one of a speed of the elevator car, an acceleration of the elevator car, a load in the elevator car, a position of one or more doors of the elevator car, and a position of one or more brakes of the elevator car.

9. The elevator system set forth in claim 8, wherein the second network coordinator includes a microprocessor.

10. The elevator system set forth in claim 8 further comprising:

a linear propulsion system constructed and arranged to propel the elevator car, the linear propulsion system including a plurality of primary coils engaged to and distributed along the hoistway.

11. The elevator system set forth in claim 10, wherein the linear propulsion system includes a control system configured to select and energize the plurality of primary coils, the control system including a plurality of switches with each one of the plurality of switches being associated with a respective one of the plurality of primary coils, and wherein the plurality of switches selectively close to energize a selected one of the plurality of primary coils associated with a location of the elevator car.

12. The elevator system set forth in claim 11, wherein the first network coordinator is operatively associated with the control system.

13. An elevator system, comprising:

an elevator car disposed in and constructed and arranged to move along a hoistway generally defined by a stationary structure; and a near field communication system configured to provide communication between the elevator car and the stationary structure, the near field communication system including a plurality of hoistway transceivers spaced along the hoistway, a first car transceiver carried by the elevator car and disposed at an elevator car side adjacent to the hoistway transceivers, and a first network coordinator operatively coupled to the plurality of hoistway transceivers to provide un-interrupted communication, wherein the first network coordinator is operable to select which one of the plurality of hoistway transceivers interacts with the first car transceiver based on a location of the elevator car.

* * * * *